United States Patent [19]

McNinney, Jr. et al.

[11] 4,325,292

[45] Apr. 20, 1982

[54] BLAST ROOM FLOOR

[76] Inventors: Richard P. McNinney, Jr., 9707 Braeburn Glen, #102; Robert E. Thompson, 9206 Cadawac, both of Houston, Tex. 77074

[21] Appl. No.: 87,291

[22] Filed: Oct. 22, 1979

Related U.S. Application Data

[63] Continuation of Ser. No. 844,602, Oct. 25, 1977, abandoned.

[51] Int. Cl.[3] ..... B08B 15/02; B05C 15/00

[52] U.S. Cl. ..... 98/115 SB; 51/424; 118/312

[58] Field of Search ..... 98/115 R, 115 SB; 51/424, 425; 118/312

[56] References Cited

U.S. PATENT DOCUMENTS

| | | | |
|---|---|---|---|
| 2,912,918 | 11/1959 | Mead | 98/115 SB |
| 3,026,789 | 3/1962 | Mead | 51/425 X |
| 3,320,927 | 5/1967 | Szczepanski | 98/115 SB X |
| 3,657,991 | 4/1972 | Oberg | 98/115 R X |
| 3,672,292 | 6/1972 | Arnold | 51/424 X |
| 3,814,002 | 6/1974 | Rombach et al. | 118/312 X |

FOREIGN PATENT DOCUMENTS

| | | | |
|---|---|---|---|
| 1449941 | 9/1976 | United Kingdom | 51/424 |

*Primary Examiner*—Wm. Carter Reynolds

*Attorney, Agent, or Firm*—Gunn, Lee & Jackson

[57] ABSTRACT

A blast room floor construction is disclosed, and the preferred and illustrated embodiment incorporates an overhead grate of substantial strength to enable a workman and work materials to be located thereon. The blast cleaning procedure forms a cloud of dust and residue which falls through the grate. Therebelow, multiple pieces are utilized to construct sloping, parallel sidewalls which form valleys. In each valley, there is located a hollow, rectangular vacuum tube. Vacuum is pulled through the tube. It has a number of holes formed in the tube which enable the sand and blast residue to flow through the holes into the tube, which are carried away for reuse. The valley is defined by adjacent sides of angle plate material. In addition, a diamond shaped sheet is folded across a diameter to define a pair of funnel surfaces where the diamond shape having notches formed in opposite corners to fit over the tube to carry the granular materials toward the hole in the tube. The entire apparatus can be assembled and disassembled quite readily from a few basic parts.

4 Claims, 4 Drawing Figures

BLAST ROOM FLOOR

This is a continuation of application Ser. No. 844,602 filed on Oct. 25, 1977, now abandoned.

BACKGROUND OF THE PROBLEM

Blast room collection and classification of sand, grit or abrasive media and blast debris is the subject matter of the present disclosure. Certain references are known, including U.S. Pat. Nos. 2,912,918 and 3,026,789. The present invention is directed at a blast room floor construction formed of a few basic parts. Indeed, only four basic parts are required for the present invention, and of that number, all of the parts can be cut to abut the walls or borders around the blast room. The parts can be cut to suitable lengths so that they can be used to assemble a blast room floor of any selected dimension. The present invention thus can form a blast room floor having any length desired, the ends being cut off to match the length of the room and the width matching some multiple of the width of one unit. If the width is some nominal measure, such as one foot, any blast room floor can be constructed to the nearest one foot measure. Any surplus space beyond this but less than the nominal width is readily blanked off. The present invention thus yields a blast room floor free of welding which is simply assembled together at the point of usage. Because it is not welded, it can be assembled with a minimum of hand labor. Notwithstanding the fact that it is formed with relatively easy hand labor, it assembles into a very effective recovery system for abrasive and debris from blast cleaning operations.

In many manufacturing plants, it is necessary to routinely blast clean parts. This is done at a fixed work station which is normally called a blast room. Blast cleaning equipment is installed adjacent to the work station, and a sandblast hose with nozzle is located in the blast room. The hose is handled by a workman. The workman normally positions the object to be blasted on the floor and sandblasts the work piece. A curtain may confine the cloud of dust or sufficient ventilation is provided to control the dust. Ventilation air flow may be provided by pulling a sufficient quantity of air through the vacuum tubes of the floor. Typically, an overhead roof or ceiling prevents the cloud of dust from sailing over surrounding walls. Thus, the spent abrasive and the debris blasted from the work piece eventually settle down onto the floor.

The abrasive used in the blast cleaning operation has substantial value. It is preferable to recover it. It cannot be merely left on the floor, this forming an accumulation which gets in the way. Rather, it is desirable to have a grate floor to permit the abrasive to sift through the grate and out of the way. This gets it out of the way so that it will not thereafter interfere with the blasting process. The workman can thus go on about his business.

After the abrasive sifts through the floor, it falls on some type of recovery apparatus. The present invention is able to recover the spent abrasive. It is collected by a convenient vacuum flow system for transfer to classifying apparatus which removes the metal cuttings, debris and other trash. Then the abrasive media can be recycled and used again. Abrasive particles which become broken and thus become unwanted dust are also removed.

After the abrasive and debris have settled through the grate, they are collected by the present apparatus, taken to a classifier and reused. The present apparatus is particularly adapted for installation as a collector floor because it is able to be readily constructed in situ with a minimum of effort. It can be installed as a blast room floor at the time of construction and installed with a minimum of hand labor. Basically, the equipment is installed substantially without welding and, therefore, is quickly and easily put in place.

BRIEF DESCRIPTION OF THE PREFERRED EMBODIMENT

The illustrated and preferred embodiment is a blast room floor construction formed of a minimum of pieces and adapted to be installed beneath a grate. It is formed of a minimum of pieces into parallel adjacent valleys. Each valley is defined by a relatively wide angle plate. These are placed adjacent to one another. They are maintained in their upright posture by vertical plates between them which serve as a cap which extends the full length of the valley. The cap has right and left edge overhangs which hook over the angle plate. A vacuum tube in the form of a small, hollow, rectangular pipe is placed in the bottom of each valley. It has suitable holes drilled in it so that vacuum flow will pick up abrasive and debris. The holes are spaced along the vacuum tube. Abrasive is directed to them by transverse sloping inserts rested on top of the vacuum tube. These are formed of diamond shaped stock folded transversely across the middle and placed between valleys. The vacuum tubes extend to a collection manifold at the end.

DETAILED DESCRIPTION OF THE ILLUSTRATED EMBODIMENT

Figure 1:
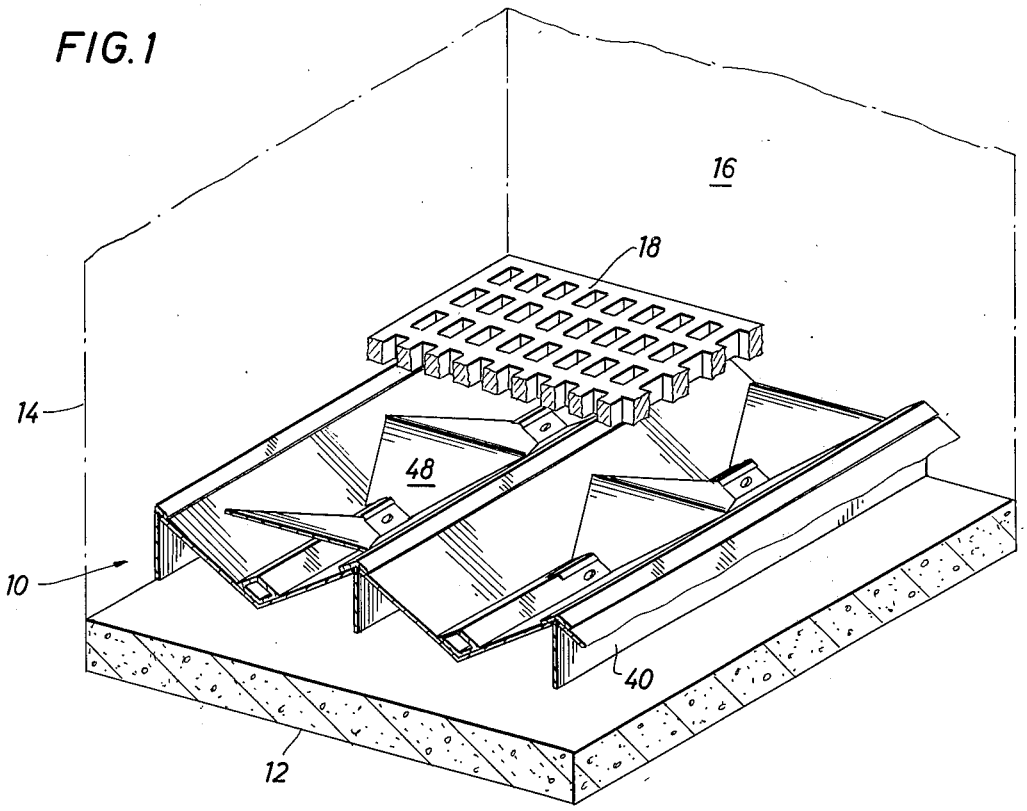
FIG. 1 is a perspective view of a blast room floor utilizing the construction taught by the present invention and showing the position of the blast room floor beneath an overhead grate.

Attention is first directed to FIG. 1 of the drawings where the blast room floor construction of the present invention is identified by the numeral 10. It is installed in a room which is a closed work area. The closed work area has a floor 12, walls 14 and 16, a roof (not shown) and a drape over the entrance or door. This typical construction of a blast room defines a work area where a workman and a work piece are supported on a horizontal grate 18. The grate has numerous holes in it. During the blast cleaning process, great clouds of abrasive or blast particles along with debris from the work piece are liberated, and they sift downwardly through the holes in the grate. The blast room floor 10 of the present invention defines an apparatus which picks up these particles. It prevents particle accumulation on the top side. Moreover, it permits them to flow through the grate and to be carried away for recycling.

The present invention defines multiple parallel valleys. Only one will be described, and it can thereafter be extended to the full width of the room. To this end, attention is directed to FIG. 2 of the drawings. Proceeding with the lefthand valley show there, it will be presumed that it is abutted against a wall. A wall piece 20 stands erect against the wall. It is leaned against the wall and held there. It is a vertical plate. It has a cap on it which is ordinarily formed of left and right ledges which fold over and extend the length thereof. The lefthand ledge is omitted. The right ledge 22 overhangs slightly and serves as a lock joining the wall piece 20 to an adjacent member. The wall piece 20 has any suitable length and preferably is a maximum length equal to the length of the room.

A piece of angle material defines the valley. The angle material has walls or sides identified by the numerals 24 and 26. They are preferably at right angles to one another. The two angle plates 24 and 26 form the valley itself. They preferably have the same width. Accordingly, when rested on the floor 12, they have a height which is common to the wall plate 20. The wall plate 20 is only slightly taller to enable the overhanging ledge to extend over the plate 24. The plates 24 and 26 have a length which is preferably approximately equal to that of the room. They do not have to be full length, and multiple sections can be used. Thus, all of the stock of the present invention can be made in standard lengths to assemble a full blast room floor. As an example, the material may come in standard lengths of eight feet and adjacent sections abutted against one another to form a longer valley. The dimensions are not critical to construction of a blast room floor.

The angle plate is formed with a valley between right angle sides. The valley of the angle plate, when in position, supports a vacuum tube 30. The tube 30 is hollow to provide an axial passage for vacuum flow. It is drilled with occasional holes at 32. Ideally, it is positioned so that two faces are exposed to an overhead view. The two faces are both drilled. It is not necessary to place many holes in the vacuum tube 30. However, the best arrangement is to position holes on each face at spaced locations evenly along the length of the tube. For instance, the holes can be arranged evenly, about ten inches apart. Other measures can, of course, be used. With even spacing, each pair of openings must service a common and equal work area. This provides a means of egress for all of the blast particles and debris which settle through the grate 18.

The tube 30 may have any internal dimension limited by the overall height of the floor. The hole 32 is approximately one-half to one inch in diameter or so. If it is too large, it bleeds off too much vacuum, i.e., introduces too much air to the tube. If it is too small, it may not induct the sand particles and debris rapidly enough and is easily blocked. Thus, the hole may require variation dependent on the size of the grit, the rate at which grit falls through the grate 18 and other scale factors.

Figure 2:
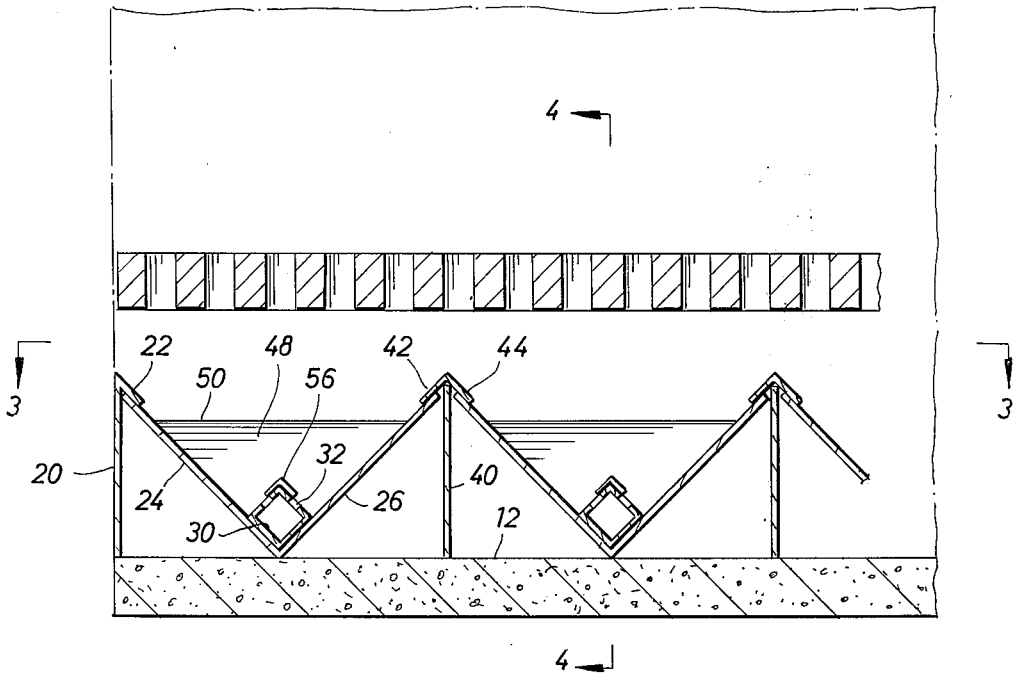
FIG. 2 is a transverse sectional view through multiple installations of the blast room floor showing how a room of specified width is covered.
Figure 3:
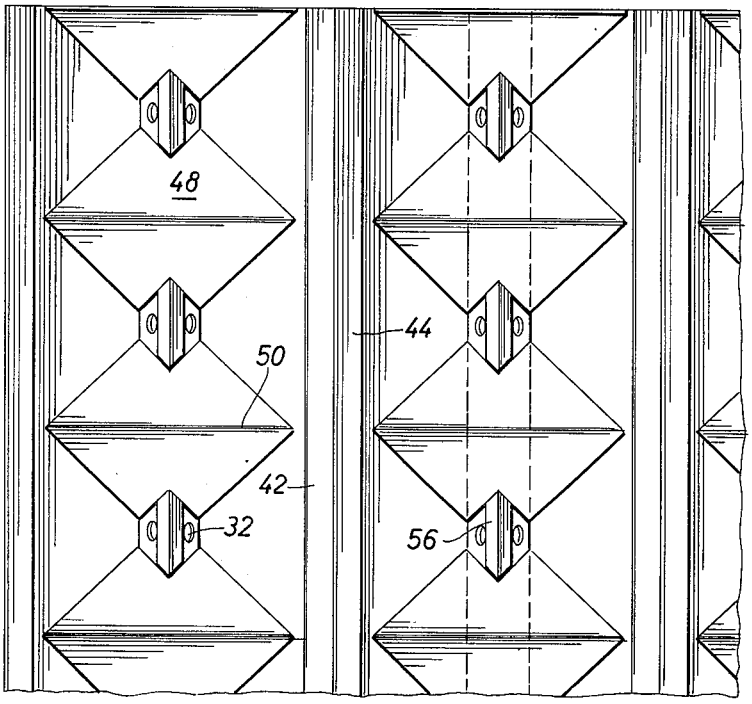
FIG. 3 is a top view of the floor showing parallel valleys and adjacent diamond shaped deflectors.
Figure 4:
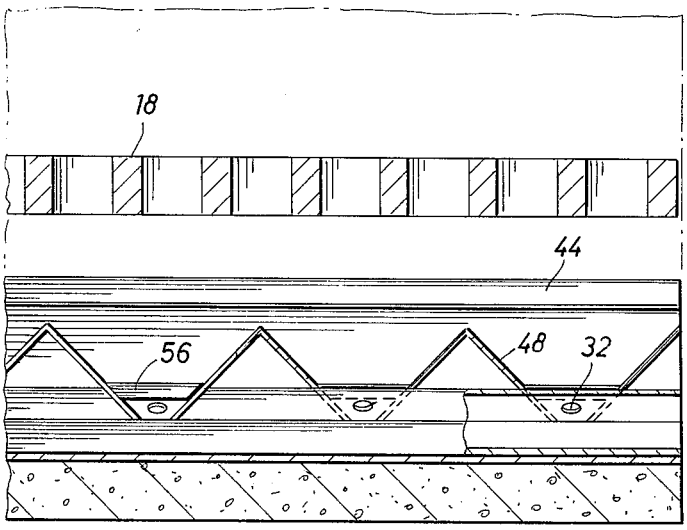
FIG. 4 is a sectional view through a vacuum tube showing how multiple holes along the length of the vacuum tube pick up and directed thereinto by the diamond shaped transverse deflectors.

Proceeding on to the right in FIG. 2, the numeral 40 identifies a plate very similar to the wall plate 20. It is identical in all regards except it includes left and right side located overhang portions 42 and 44. They have a width equal to the overhang 22 and are set at a common angle, preferably ninety degrees. The plate 40 is used at locations where two valleys are adjacent to one another. The plate 20 is used only adjacent to the wall. They do, however, function in a common manner. Again, the length is substantially indefinite, being limited only by practical considerations and scale factors.

It will be observed that the plate 40 locks in position adjacent valleys. It also defines and limits an immediate water shed area where the granular particles falling through the grate are directed into one valley or the other. The overhang portions 42 and 44 also prevent leakage of fallout through the slots between adjacent valleys.

As shown in FIG. 2 of the drawings, the openings at 32 are between sloping walls 24 and 26. There are two additional slopes directing granular material towards the openings. Each additional slope is found on an insert plate 48. The insert plate 48 is fabricated from flat stocks folded and cut. It is first cut in an approximate diamond shape. It is then folded across a diagonal. It thereby supports symmetrical front and back faces between the valleys 24 and 26. These two faces are adjacent to one another, being located on opposite sides of the insert 48. Thus, an insert is placed on each side of each opening. The insert 48 has an assembled width which is less than the spacing between consecutive openings 32 in the vacuum tube 30. In other words, the insert 48 covers a substantial portion but less than the entire length of the vacuum tube between consecutive pairs of drilled holes. The inserts cooperate with the sides of the angle sections to define a plurality of four sided funnels that direct particulate matter into the holes in the vacuum tubes. Each of the funnels is defined by a pair of the inserts 48 longitudinally placed in one of angle sections and separated by spacers 56. If the holes are ten inches apart, the insert spans about eight inches or so. It should come reasonably close to the openings 32 so that it tends to funnel the particulate matter towards the openings 32.

The insert 48 has a ridge 50 which extends from between opposite corners of the diamond sheet stock. The opposite tips of the diamond sheet are notched to fit around the vacuum tube. Thus, the two openings 32 are isolated between four sloping surfaces which tend to funnel granular material toward them for removal. The insert 48 is ideally locked adjacent to the openings 32. This is achieved by resting a short piece of angle stock 56 on the top ridge of the vacuum tube 30. The piece 56 abuts two inserts 48 and holds them a fixed distance apart. The inserts are thus properly spaced to enable granular material to settle toward the openings 32 in the vacuum tube. Each of the four sided funnels is positioned above respective ones of the holes of the vacuum tubes. The funnels each consist of (i) the first side of the angle section, (ii) one side of an insert, (iii) the second side of the angle section, and (iv) one side of another one of the inserts. The blast room floor of the present invention is thus assembled in any length required. Its width is dependent on the width of a basic single valley which is installed in multiples across the room.

With this arrangement, the floor can be fully covered. The material can be cut to length to accommodate one dimension of the room, and the width is covered with multiple valleys. A marginal area which has a width less than the width of a single valley may remain. It is possible to blank off this remaining area. Alternately, a single valley portion can be cut lengthwise so long as it is sufficiently wide to still include a vacuum tube 30 at the bottom crest.

The foregoing is directed to the preferred embodiment of the present invention, but the scope thereof is determined by the claims which follow.

We claim:

1. An apparatus for collecting blastroom particles, debris, and other particulate matter which settles on the floor thereof, comprising:

(a) a first wall piece adapted to abut a single wall of the blastroom;

(b) a plurality of similar angle sections disposed parallel to said first wall piece, each of said angle sections including first and second sides disposed at an angle to one another to form a V-shaped valley therebetween and being positioned so that said first wall piece supports one of said angle sections in an upright position with the valley thereof exposed to receive falling particulate matter thereon;

(c) a plurality of lock plates to secure said angle sections in upright positions relative to said first wall piece above the floor of the blastroom;

(d) a plurality of vacuum tubes each having a plurality of holes therein along the length thereof and adapted to remove particulate matter by vacuum flow, a respective one of said vacuum tubes being longitudinally disposed in each of said angle sections between the first and second sides thereof to expose the holes therein to enable the particulate matter to enter therein;

(e) a plurality of identical multi-sided inserts positioned longitudinally in said angle sections over said vacuum tubes to funnel particulate matter into the holes in said vacuum tubes for removal of the particulate matter from the blastroom, said inserts having notches therein constructed and arranged to fit over said vacuum tubes; and (f) a plurality of spacers placed on said vacuum tubes to position said inserts along said tubes so that the particulate matter funnels toward the holes disposed therein.

2. The apparatus of claim 1 wherein a grate is supported above said first wall piece and said lock plates and is adapted to support a workman and workpiece to be sandblasted.

3. The apparatus of claim 1 wherein each of said lock plates having symmetric edges which overhang the first and second sides of adjacent angle sections, said symmetric edges being adapted to lock and support said adjacent angle sections in position and to direct particulate matter into the valleys of said angle sections.

4. The apparatus of claim 1 wherein a plurality of four sided funnels direct particulate matter into the holes in said vacuum tubes, each of said funnels being formed by a pair of said inserts longitudinally placed in one of said angle sections and separated by said spacer which is positioned above the holes in said vacuum tube; said four sided funnel consisting of: (i) the first side of said one angle section, (ii) one side of one of said pair of inserts, (iii) the second side of said one angle section, and (iv) one side of the other of said pair of inserts.

* * * * *